US006377182B1

(12) United States Patent
Devine et al.

(10) Patent No.: US 6,377,182 B1
(45) Date of Patent: Apr. 23, 2002

(54) SMOKE DETECTOR WITH SENSOR HAVING IMPROVED MOUNTING CONFIGURATION

(75) Inventors: Mark A. Devine, Shorewood; Mark A. Watson, Plainfield; Andrew J. Ivanecky, Aurora; Lulzim Osmani, Glen Ellyn; Kenneth L. Venzant, Bolingbrook; Samuel D. Lopez, Oswego, all of IL (US)

(73) Assignee: BRK Brands, Inc., Aurora, IL (US)

( * ) Notice: Subject to any disclaimer, the term of this patent is extended or adjusted under 35 U.S.C. 154(b) by 0 days.

(21) Appl. No.: 09/692,758

(22) Filed: Oct. 19, 2000

Related U.S. Application Data

(60) Provisional application No. 60/165,874, filed on Nov. 16, 1999.

(51) Int. Cl.[7] ..... G08B 17/10
(52) U.S. Cl. ..... 340/628; 340/629; 340/630
(58) Field of Search ..... 340/628, 629, 340/630, 632

(56) References Cited

U.S. PATENT DOCUMENTS 4,319,234 A * 3/1982 Rice ..... 340/328
4,796,015 A * 1/1989 Admire, Jr. ..... 340/693
4,887,073 A * 12/1989 Nakao et al. ..... 340/693
5,729,207 A * 3/1998 Yamano ..... 340/628

OTHER PUBLICATIONS

The configuration of a smoke detector as shown in Figures 1A, 1B and 1C of the attached sheet from the present application illustrating the configuration of a prior art smoke detector of a type on sale in the USA more than a year before the earliest filing date the present application is entitled to claim.

* cited by examiner

*Primary Examiner*—Edward Lefkowitz
(74) *Attorney, Agent, or Firm*—Rockey, Milnamow & Katz, Ltd.

(57) ABSTRACT

A smoke detector has a geometry that locates a sensor or sensors at or near a boundary layer of smoke movement thus facilitating smoke entry into the sensor and/or sensors. The sensors are mounted so as to protrude from the bottom of a cover instead of into the cover of the detector.

38 Claims, 3 Drawing Sheets

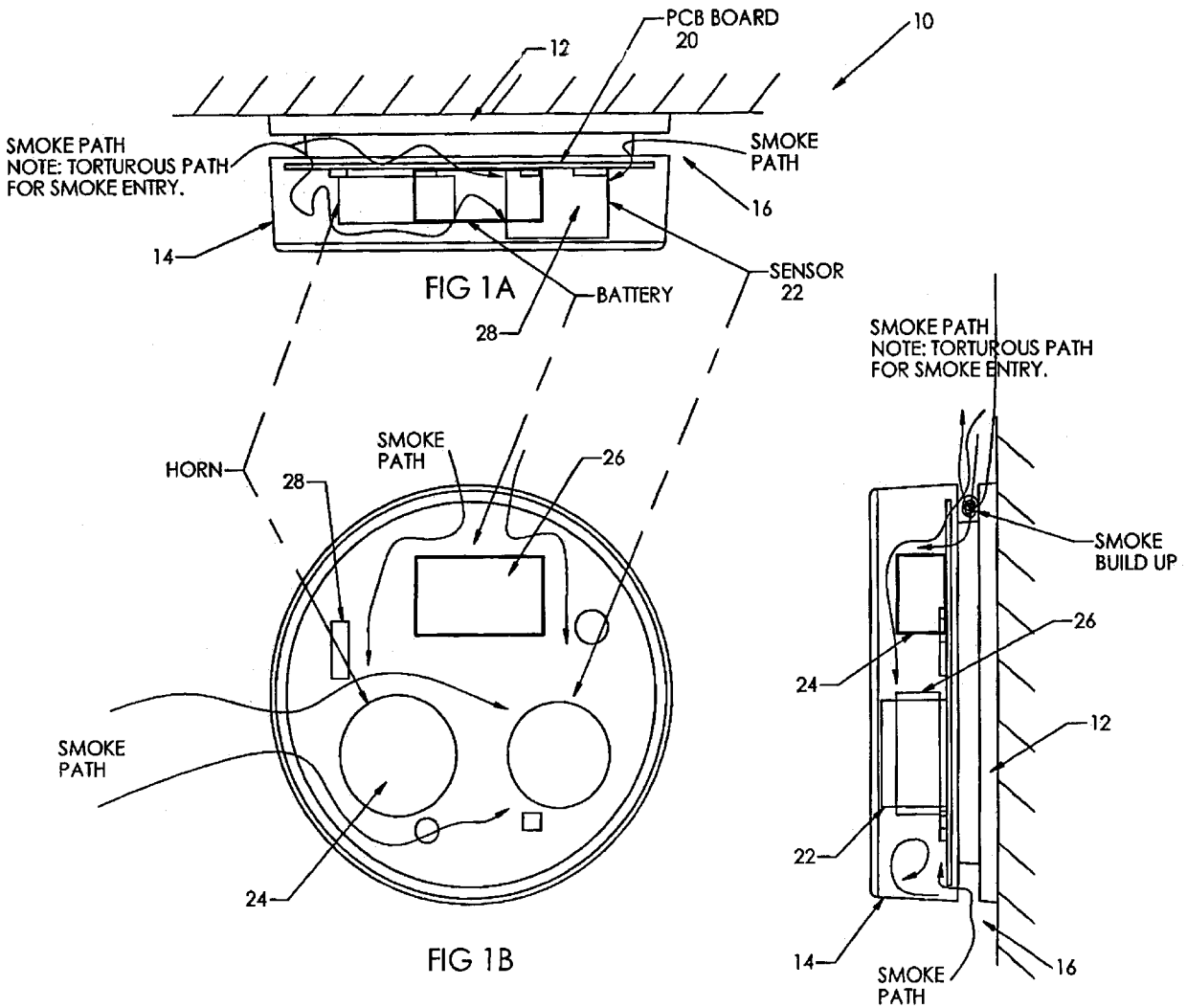
PRIOR ART

INVERTED SENSOR SMOKE DETECTOR

DUAL SENSOR

SMOKE DETECTOR WITH SENSOR HAVING IMPROVED MOUNTING CONFIGURATION

This application claims the benefit of the earlier filing date of Provisional Application Ser. No. 60/165,874, filed Nov. 16, 1999.

FIELD OF THE INVENTION

This invention pertains to ambient type sensors such as photoelectric and ionization smoke detectors. More particularly, the invention pertains to structures for locating the respective sensor/sensors with an orientation that facilitates the ingress of smoke into the sensors

BACKGROUND OF THE INVENTION

Known smoke detector designs mount the respective sensor inside a housing or on top of the housing. Both ionization and photoelectric sensors have been located inside housings having complicated vents and baffling designs in order to promote the ingress of smoke. Smoke detectors having sensors mounted inside the cover of the detector may have barriers such as the p-horn, battery, or other electrical components that interfere with smoke detection due to interference with smoke flow.

FIGS. 1A–1C illustrate relevant aspects of a prior art smoke detector 10. The detector 10 includes a base 12 intended to be attached to a ceiling C. A cover 14 is carried on the base 12. A plurality of openings indicated generally at 16 provide smoke pathways into and out of the cover 14.

In the detector 10, a printed circuit board 20 is carried adjacent to the mounting base 12. The printed circuit board 20 in turn carries an ambient condition sensor, such as a smoke sensor 22, an audible output device such as a horn or the like 24, and a power supply such as a battery 26. Other electrical or electronic components generally indicated at 28, are conventionally carried by the printed circuit board 20 often on the same side as are sensor 22, horn 24 and battery 26.

The configuration illustrated in FIGS. 1A, 1B and 1C results in convoluted and tortuous smoke flow paths in and out of openings 16 and into cover 14. Placing the sensor 22 on the printed circuit board as in FIGS. 1A, 1B and 1C directs the sensor 22 into the internal volume of the cover 14 away from smoke flow adjacent ceiling C. To compensate for placement of the sensor 22, known detectors have included vents and baffles for the purpose of promoting smoke flow to and from the respective sensor.

It would be desirable from a cost and design manufacturing perspective to be able to eliminate known vents, baffles and flanges. Preferably such reduced complexity might promote improved flow into and out of the respective housings.

SUMMARY OF THE INVENTION

The invention takes advantage of both the laminar and turbulent nature of smoke flow. Often smoke detectors are ceiling mounted. The sensor or sensors are arranged within the detector so as to be located near the respective mounting surface, such as near or on the ceiling.

The sensors are carried adjacent to a mounting surface of the detector as opposed to being mounted in the cover as in prior art smoke detectors. The design hereof displaces the sensor/sensors away from electronic components and closer to the mounting surface such as the ceiling. An air sampling gap exposes the sensor/sensors to air and smoke adjacent to the ceiling.

One or more sensors (ionization or photoelectric) may be carried adjacent to the mounting member for the detector. The present invention promotes omni-directional ingress of smoke into the detector.

Unlike the prior art, this invention eliminates the need for complicated venting geometries and complex baffling designs. This follows since the sensors are located adjacent to the mounting surface so as to promote direct ingress and egress of airborne smoke, and thus improved directionality.

Numerous other advantages and features of the present invention will become readily apparent from the following detailed description of the invention and the embodiments thereof, from the claims and from the accompanying drawings.

BRIEF DESCRIPTION OF THE DRAWINGS

FIGS. 1A, 1B and 1C taken together are various views of a prior art smoke detector;

FIG. 3A is a side elevational view of a dual sensor detector in accordance with the present invention;

FIG. 3C is a side sectional view taken along plane 3C—3C of FIG. 3B.

DETAILED DESCRIPTION OF THE PREFERRED EMBODIMENTS

Figure 2A:
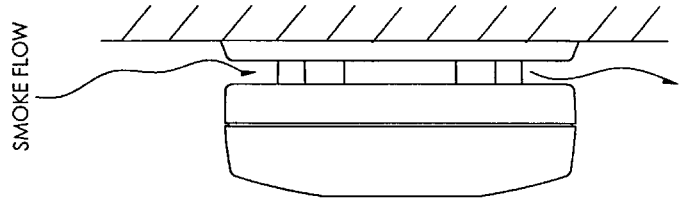
FIG. 2A is a side elevational view of a detector in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

Figure 2B:
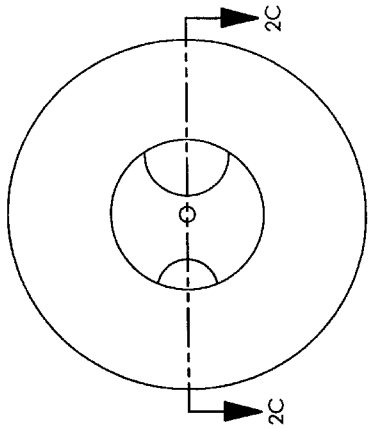
FIG. 2B is a top plan view of the detector of FIG. 2A taken along plane 2A—2A.
Figure 2C:
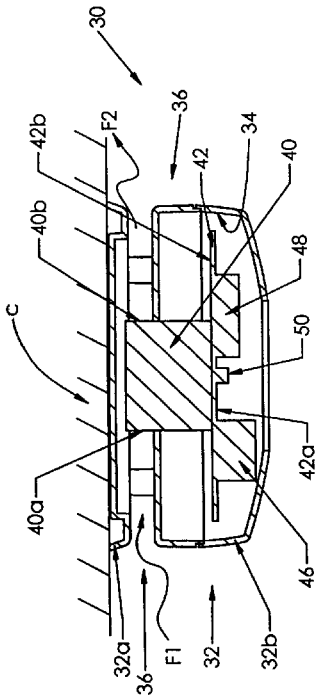
FIG. 2C is a side sectional view of the detector of FIG. 2A taken along plane 2C—2C.

FIGS. 2A, 2B, 2C illustrate various views of a detector 30 in accordance with the present invention. The detector 30 includes a housing generally indicated at 32 having a base **32*a* which is intended to be attached to a mounting surface such as a ceiling C. The housing 32 includes a cover 32*b* coupled to the base 32*a***.

The cover **32*b* substantially defines an internal region 34. The region 34 is open to the ambient atmosphere via slots, ports or openings generally indicated at 36 located adjacent to the base 32*a*. The openings or slots 36 are disposed around the housing 32**.

The housing 32 carries an ambient condition sensor 40, which could be a smoke sensor, with a portion thereof positioned adjacent to the base **32*a*. The sensor 40 could be carried within the region 34 by a planar mounting element 42. Element 42** could be implemented as one or more printed circuit boards.

The element 42 carries an audible output device 46 and a power supply, for example a replaceable battery 48, on a side **42*a* displaced from a side 42*b* upon which the sensor 40 is mounted. Other electronic components 50, for example control circuitry, as would be understood by those of skill in the art could be carried on the side 42*a* interconnected with audible output device 46 and battery 48. Electrical connections to sensor 40 could be made using plated through holes or vias in the board 42** or other known methods as would be understood by those of skill in the art.

The configuration of detector 30 is particularly advantageous in that sensor 40 has input/output openings 40*a*, 40*b* which are in an ambient atmospheric flow pattern indicated generally at F1 and F2 through openings 36. In this regard, the position of other components 46, 48 and 50 on side 42*a* of the board or element 42 has located those components out of the ambient flow stream, F1, F2.

An inflow and outflow F1, F2 of ambient atmosphere, which could carry fire indicating smoke, is able to flow unimpeded into and out of sensor 40 in a symmetrical fashion relative to the housing 32. No special vanes or deflecting elements are required to cause inflow or outflowing ambient, smoke carrying, atmosphere to flow into openings 40*a*, 40*b* of sensor 40 since those openings and the associated portions of sensor 40 are located directly in the flow path.

It will be understood that the sensor 40 could be implemented as an ionization-type or photoelectric-type smoke sensor without departing from the spirit and scope of the present invention. Other types of smoke sensors or gas sensors if desired could also be used without departing from the spirit and scope of the present invention. Preferably sensor 40 would be symmetrically located on a center line L of housing 32.

Figure 3B:
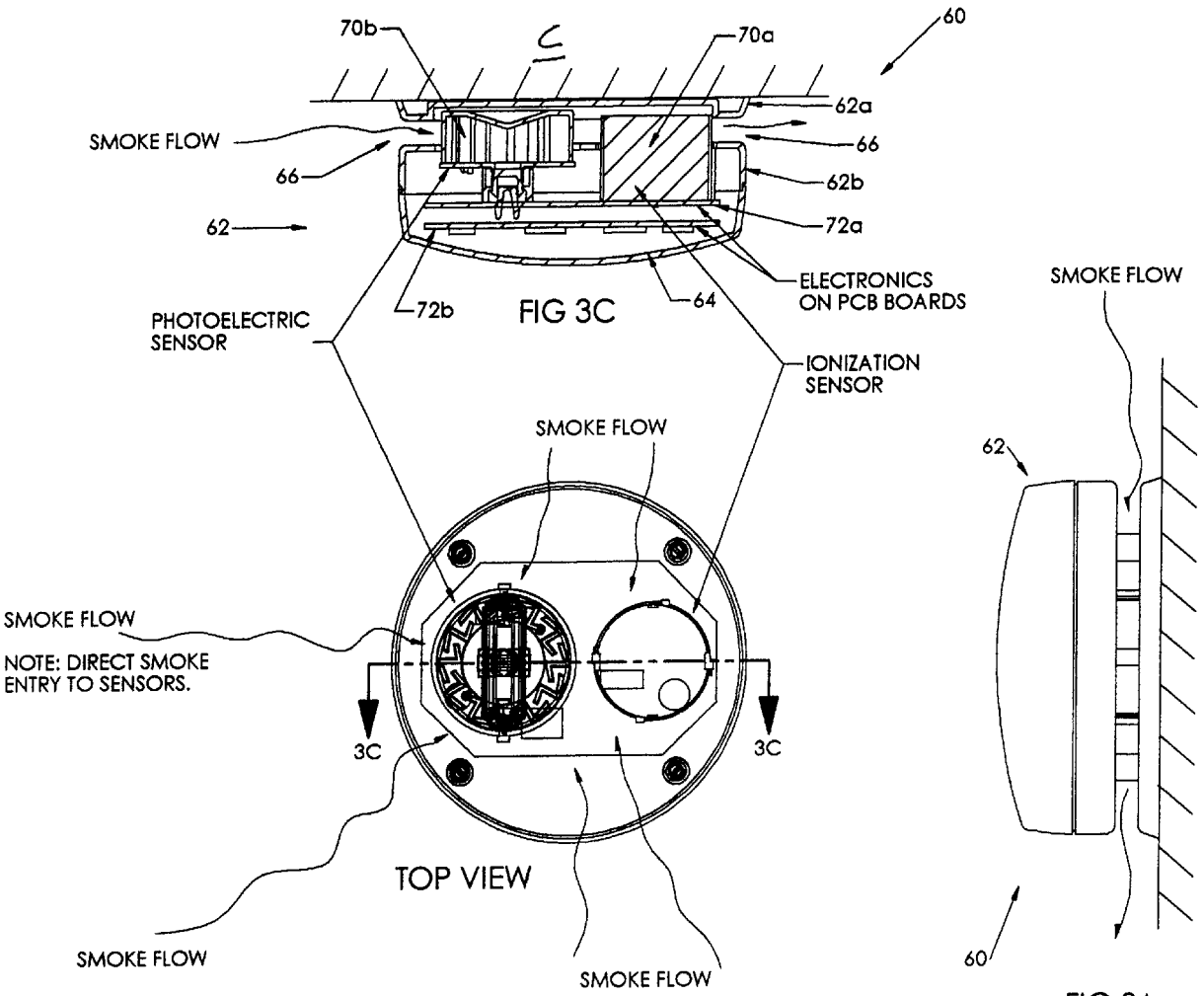
FIG. 3B is a view taken along plane 3B—3B of FIG. 3A.

FIGS. 3A, 3B and 3C illustrate various views of a dual sensor detector 60 in accordance with the present invention. Detector 60 includes a housing generally indicated at 62 which has a base 62*a* intended to be mounted to a surface such as a ceiling C. Additionally, housing 62 includes a cover 62*b* which substantially defines an internal region 64. A plurality of openings, generally indicated at 66, provides for an inflow and outflow of ambient atmosphere which could include airborne smoke which has accumulated adjacent to ceiling C.

Detector 30 includes first and second ambient condition sensors 70*a* and 70*b*. By way of example, and not limitation, sensor 70*a* could be implemented as an ionization-type smoke sensor. Sensor 70*b* could be implemented as a photoelectric-type smoke sensor. One of the sensors could be a gas sensor.

The sensors 70*a*, 70*b* are mounted on a printed circuit board 72*a* carried in housing 62. The printed circuit board 72*a* and the sensors 70*a, b* are oriented such that inflow and outflow ports of the respective sensors are located adjacent the ports or openings 66 to promote a direct inflow and outflow of ambient atmosphere including airborne smoke therein.

For exemplary purposes, a second printed circuit board 72*b* can be mounted adjacent to the circuit board 72*a* and carry additional components such as audible output device, a piezo electric horn, control circuitry and a power supply which could include a replaceable battery. These respective components would be carried on printed circuit board 72*b* and oriented so as to not impinge upon or alter the ingress and egress of airborne ambient, such as airborne smoke, through openings 66. As illustrated in FIG. 3B, ingress and egress of airborne ambient can occur symmetrically relative to housing 62 and impinge upon the sensors 70*a, b* without obstruction from or deflection due to other components in the detector.

It will be understood that the choice of sensors 70*a, b* is exemplary. Other choices such as smoke and gas sensors could also be used without departing from the spirit and scope of the present invention. It will also be understood a variety of mounting arrangements could be implemented with base 62*a* without departing from the spirit and scope of the present invention.

The cover of the sensor may include a myriad of designs since adding vents, holes, etc. will not affect the sensor/sensors behavior in the detection of airborne smoke particulates, gas, etc.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A surface mountable smoke detector comprising:

a housing which bounds, at least in part, an internal volume and which has a mounting side positionable adjacent a mounting surface;

at least one smoke sensor carried within the housing and located adjacent to the mounting side wherein the housing is open, in part, to provide substantially symmetrical in-flow and out-flow of ambient atmosphere adjacent the mounting surface to and from the sensor.

2. A detector as in claim 1 wherein the sensor is mounted on a center line of the housing without obstruction of ambient inflow and outflow by other components.

3. A detector as in claim 1 which includes a printed circuit board wherein that board has first and second sides with the sensor mounted on one side and including an output transducer mounted on another side.

4. A detector as in claim 1 which includes a printed circuit board wherein that board has first and second sides with the sensor mounted on one side and including control circuitry mounted substantially on another side.

5. A detector as in claim 4 which includes a power supply substantially mounted on the another side.

6. A detector as in claim 5 wherein the power supply includes a replaceable battery.

7. A detector as in claim 1 which includes a second ambient condition sensor.

8. A detector as in claim 7 wherein the second sensor is one of a smoke sensor, a CO sensor, a gas sensor, and a flame sensor.

9. A detector as in claim 7 wherein the sensors are co-located adjacent to the mounting side so as to exhibit substantially no asymmetrical restrictions on in-flow and out-flow of ambient smoke.

10. An ambient condition detector comprising:

a housing which has a base and a cover;

an ambient condition sensor which protrudes from the cover and extends toward the base whereby the housing facilitates a symmetrical inflow of ambient atmosphere into the sensor.

11. A detector as in claim 10 wherein portions of the housing, adjacent to the base, are open to the inflow of ambient atmosphere.

12. A detector as in claim 10 wherein the housing is symmetrical about a centerline and the sensor is located on the centerline.

13. A detector as in claim 10 which includes a support element having first and second mounting surfaces wherein the sensor is mounted on the surface closest to the base.

14. A detector as in claim 13 which includes components mounted on the other surface so as not to block the inflow of ambient atmosphere to the sensor.

15. A detector as in claim 14 wherein the housing is symmetrical about a centerline and the sensor is symmetrically located on the centerline.

16. A detector as in claim 14 wherein the base, relative to the housing, has an exterior mounting surface and an interior surface adjacent to openings in the cover.

17. A detector as in claim 16 wherein the sensor comprises a smoke sensor.

18. A detector as in claim 17 which includes a second sensor selected from a class which includes a fire sensor and a gas sensor.

19. A detector as in claim 17 wherein the housing is substantially cylindrical.

20. A detector comprising:

a housing which defines an internal region wherein the housing has a mounting section with an exterior surface and an interior surface and wherein the housing has at least one region, adjacent to the interior surface, for atmospheric ingress and egress with a substantially planar flow path through the housing adjacent to the interior surface; and an ambient condition sensor having an atmospheric input/output region wherein the sensor is carried within the housing with the input/output region, at least in part, extending into the planar flow path.

21. A detector as in claim 20 wherein the sensor includes a mounting region, displaced from the input/output region, whereby the sensor is coupled to and carried by the housing.

22. A detector as in claim 21 which includes a support member in the housing wherein the support member has first and second spaced apart surfaces wherein the sensor is coupled to one surface and an audible output device is coupled to another surface wherein the one surface is located between the flow path and the another surface.

23. A detector as in claim 21 which includes a support member in the housing wherein the support member has first and second spaced apart surfaces wherein the mounting region of the sensor is coupled to one surface and an audible output device is coupled to another surface wherein at least one of the surfaces is between the input-output region of the sensor and the audible output device.

24. A detector as in claim 21 which includes a two-sided, mounting element carried in the housing wherein the sensor is mounted on one side with the one side located between the input/output region of the sensor and a second side and wherein control electronics coupled to the sensor is carried, in substantial part on the second side.

25. A detector as in claim 24 wherein the mounting element is planar.

26. An ambient condition detector comprising:

a substantially planar support element for conducting electrical signals wherein the element includes first and second spaced apart mounting surfaces;

a first sensor carried on a first surface of the element; and an audible output device carried on a second surface of the element which includes a housing which defines a substantially enclosed internal region with a perforated section so as to permit an inflow and outflow of ambient atmosphere wherein the planar support element is carried by the housing in the region oriented with a selected end region of the sensor extending toward the perforated section and with the audible output device extending away from the perforated section.

27. A detector as in claim 26 which includes a second sensor, carried in the housing and oriented to extend a sensing region thereof toward the inflow and outflow of ambient atmosphere.

28. A detector as in claim 26 wherein the perforated section comprises a substantially planar atmospheric flow path through the housing wherein the selected end region of the sensor extends, at least in part, into the flow path.

29. A detector as in claim 28 which includes a second sensor, carried on the planar support element and extending toward the flow path.

30. A surface mountable smoke detector comprising:

a housing which bounds, at least in part, an internal volume and which has a mounting wall;

at least one smoke sensor carried within the housing with a sensing region located adjacent to the mounting wall wherein the housing is open, in part, adjacent to the mounting wall to provide substantially symmetrical in-flow and out-flow of ambient atmosphere to and from the sensing region of the sensor; and an alarm indicating output transducer carried within the housing displaced from the inflow and outflow.

31. A detector as in clam 30 which includes a printed circuit board wherein that board has first and second sides with the sensor mounted on one side and the output transducer mounted on another side.

32. A detector as in clam 31 which includes a power supply substantially mounted on the another side.

33. A detector as in clam 32 wherein the power supply includes a replaceable battery.

34. A detector as in claim 31 which includes a second ambient condition sensor carried on the printed circuit board.

35. A detector as in claim 31 wherein a planar flow path is provided in the housing between the printed circuit board and the mounting wall.

36. An ambient condition detector comprising:

a base and a cover;

a planar flow path for flow of ambient atmosphere through the cover; an ambient condition sensor which protrudes from the cover and extends toward the base into the flow path.

37. A detector as in claim 36 which includes a support element having first and second mounting surfaces wherein the sensor is mounted on the surface closest to the base.

38. A detector as in claim 37 which includes components mounted on the other surface so as not to block the flow of ambient atmosphere to/from the sensor.

* * * * *